United States Patent [19]

Frosz

[11] 4,031,671

[45] June 28, 1977

[54] APPARATUS FOR DELIVERING FLUID GRINDING MATERIAL

[76] Inventor: Henryk N. Frosz, 54 Tranumparken, Broendby Strand, Denmark

[22] Filed: Feb. 9, 1976

[21] Appl. No.: 656,363

[52] U.S. Cl. ..... 51/263

[51] Int. Cl.[2] ..... B24B 57/00

[58] Field of Search ..... 51/263, 264, 292

[56] References Cited

UNITED STATES PATENTS

| | | | |
|---|---|---|---|
| 900,174 | 10/1908 | Klingenberg | 51/263 |
| 964,192 | 7/1910 | Vanneman | 51/263 X |
| 1,430,886 | 10/1922 | Dalton | 51/263 X |
| 2,486,322 | 10/1949 | Paul et al. | 51/263 X |
| 2,495,036 | 1/1950 | Telenik | 51/263 X |

*Primary Examiner*—Al Lawrence Smith
*Assistant Examiner*—Nicholas P. Godici
*Attorney, Agent, or Firm*—John J. Dennemeyer

[57] ABSTRACT

An apparatus for delivering a fluid grinding material to a grinding area in a grinding or polishing apparatus comprises a vessel in which a fluid grinding material is mixed and removed therefrom by conveyor means which drop it continuously in the grinding area. This automatic mixing and continuous transportation from the mixing vessel to the grinding area produces a more homogeneous grinding material in a freshly mixed non-volatile state and thereby provides an improved grinding effect.

6 Claims, 5 Drawing Figures

APPARATUS FOR DELIVERING FLUID GRINDING MATERIAL

Figure 1:
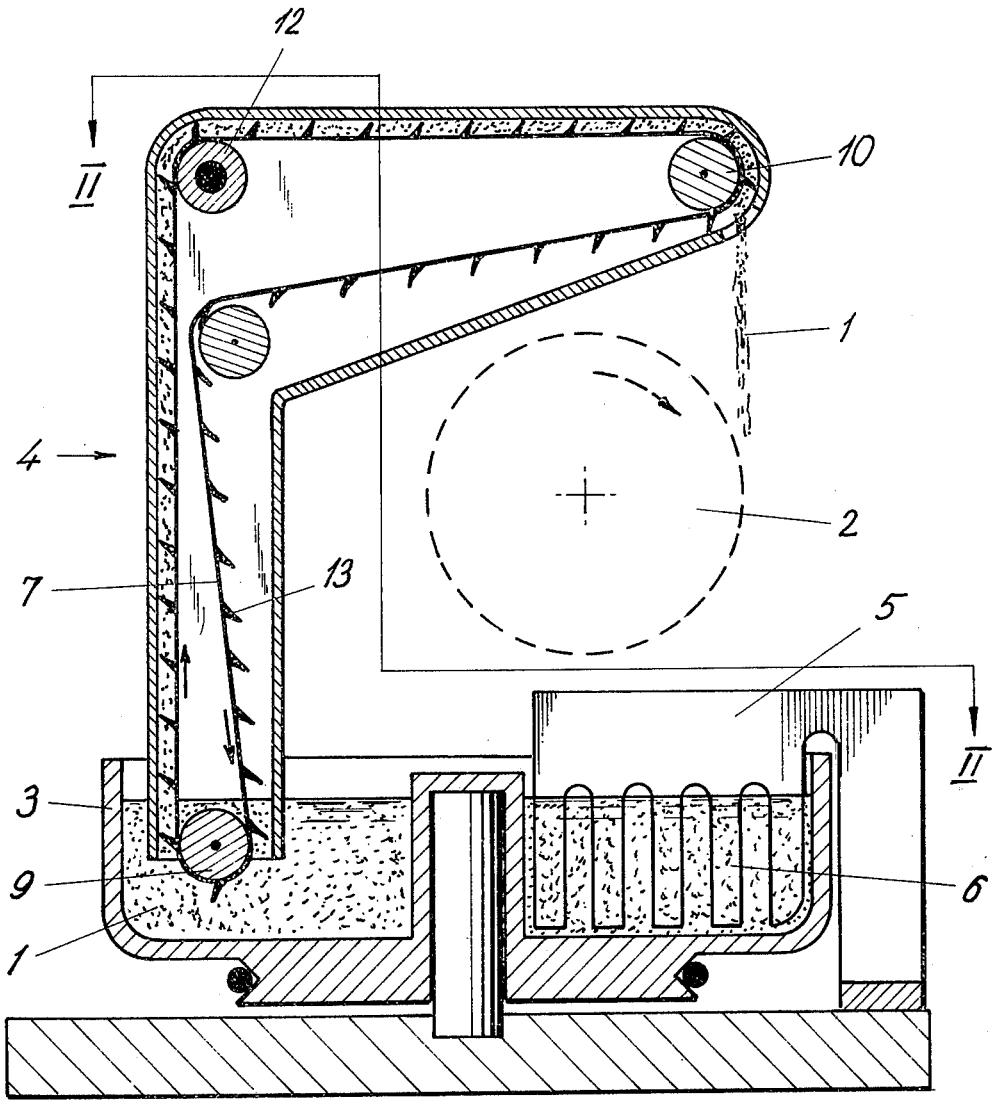

This invention relates to an apparatus for delivering a fluid grinding material to a machine for treating denture work, for example. Known processes for delivering a fluid grinding material comprise manual delivery or application of the grinding material onto a piece which is to be ground. For denture work, for example, in order to finish the grinding operation, the grinding material has to be delivered about 150 times. This is normally done by mixing abrasive powder, for example pumice, with water, stirring the mixture frequently while applying suitable quantities of liquid grinding material on the denture, and then pressing the denture against a rotating brush in the grinding machine.

The disadvantages of this process are the work involved in keeping the grinding material mixed with water in a satisfactory condition in order to obtain uniform grinding, and the frequent application onto the piece of the grinding material which has to be applied about 150 times before an average denture has been finish ground. The reason for this repeated delivery of grinding material is that it is easily brushed off during the grinding and is easily thrown off the rotating disc. Because pumice powder mixed in water is the preferred grinding material when working with dentures made of plastic material, it is desirable to remedy these disadvantages and also remedy the disadvantages in connection with grinding dentures with pumice.

The present invention in one aspect provides a process of controlling the delivery of a fluid grinding material to the place of operation in a grinding or polishing apparatus with a rotating disc or brush, the fluid grinding material being contained in a cup where it is subjected to mixing, and from which the liquid grinding material is conveyed by a conveyor means of variable capacity to the work piece to be treated near the place of the grinding or polishing operation.

The disadvantages of the previously known processes may be overcome by putting water and grinding material into a cup in which the material is constantly being stirred, and from this cup the grinding material is delivered to the piece to be ground near the place where the grinding is to be performed by means of a conveyor having variable capacity. By this process the grinding material is uniform in respect of consistency and homogeneity, resulting in a uniform grinding process. Thus the grinding operation is easier to perform and the result more uniform, which is very important for denture work. In addition, it is not necessary to stir manually in a mixing cup before the work piece is applied with the grinding material before the work piece can be treated by being pressed against the rotating brush or disc. Furthermore, a suitable quantity of grinding material is delivered to the grinding location, and the quantity can be smoothly regulated as required. The result is that it is not necessary to apply the grinding material to the work piece from a mixing cup and thus the grinding capacity is increased substantially. If there is a need for heavy grinding, the delivery of grinding material can be increased or decreased where the work to be performed is characterized as being a control of the polishing and grinding itself.

The invention in another aspect provides apparatus for carrying out the process according to the invention, comprising a cup rotated by means of a driving motor, and a comb-like element placed in the cup, the said element having teeth which extend from the edge to the center of the cup and down to the bottom of the cup.

In utilizing the apparatus according to the invention, the grinding material and a liquid are mixed very effectively and quietly and without the grinding material splashing from the cup.

The conveyor of the apparatus may comprise a rotatable band with part of the band immersed in the grinding material, whereby grinding material is conveniently carried to the place of operation. By varying the speed of the band, the amount of grinding material which is conveyed may be regulated.

The conveyor band is suitably flat and on its outer side is provided with a number of equally spaced transverse flexible pockets for containing a liquid. The pockets are preferably arranged perpendicular to the band and contain the grinding material to be carried to the place of operation.

Alternatively, the band may be of circular cross-section, which results in a compact construction because it is possible to use wheels or rollers that are very thin and shaped as V-groove pulleys. The belt is provided with slots or pockets for containing a liquid, the slots or pockets having the shape of rings on the belt and the slots or pockets contain grinding material which is delivered at the place of operation.

In another arrangement, the conveyor may be a screw conveyor which upon rotation lifts the grinding material to the place of operation.

The conveyor may include an outlet channel into which the grinding material is poured, and the channel delivers the grinding material to the place of operation. The user may be protected against splashes by a shield for the rotating disc or brush, this shield being formed by the channel and a nose which forms an extension of the channel bottom.

Figure 2:
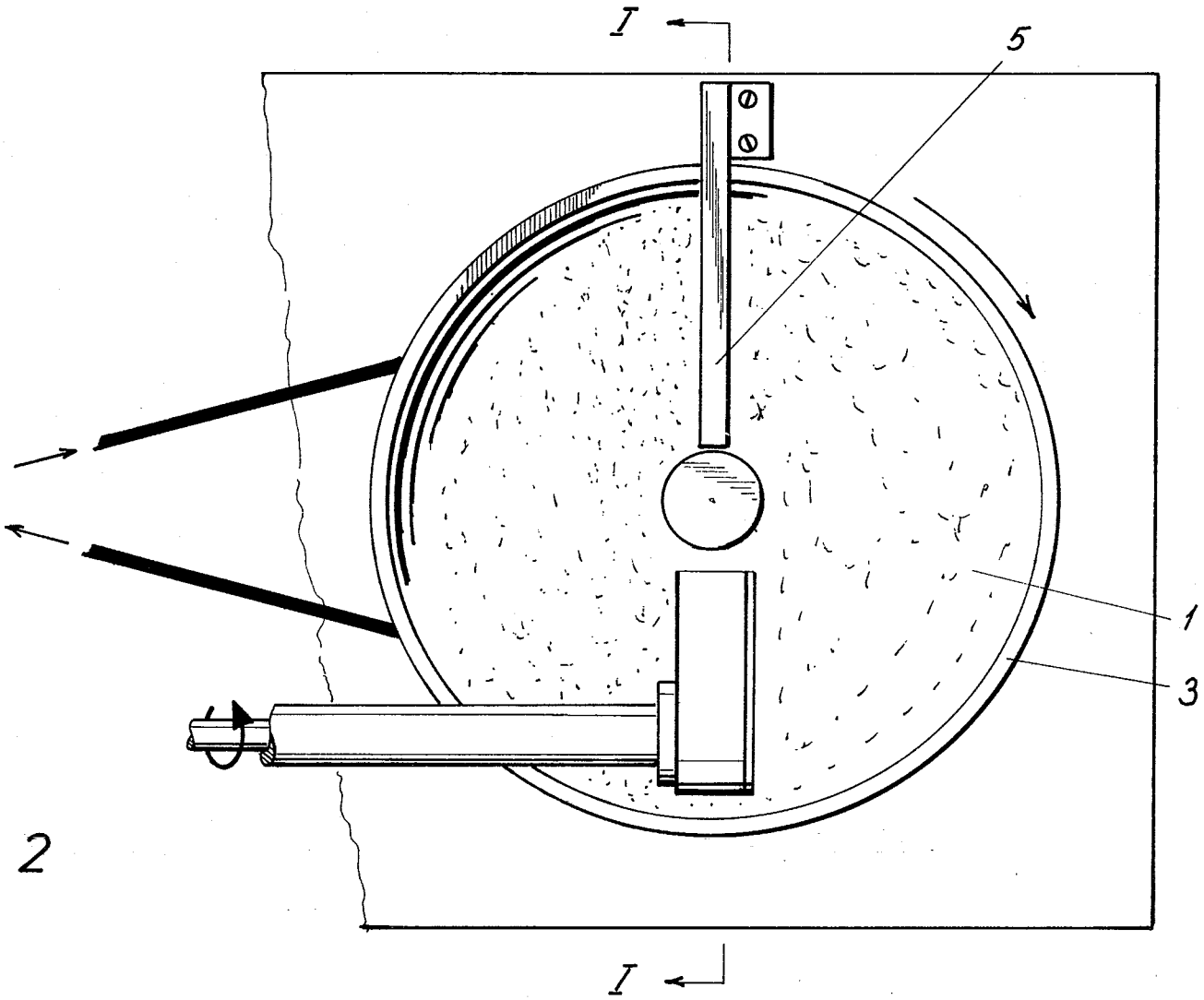
Figure 3:
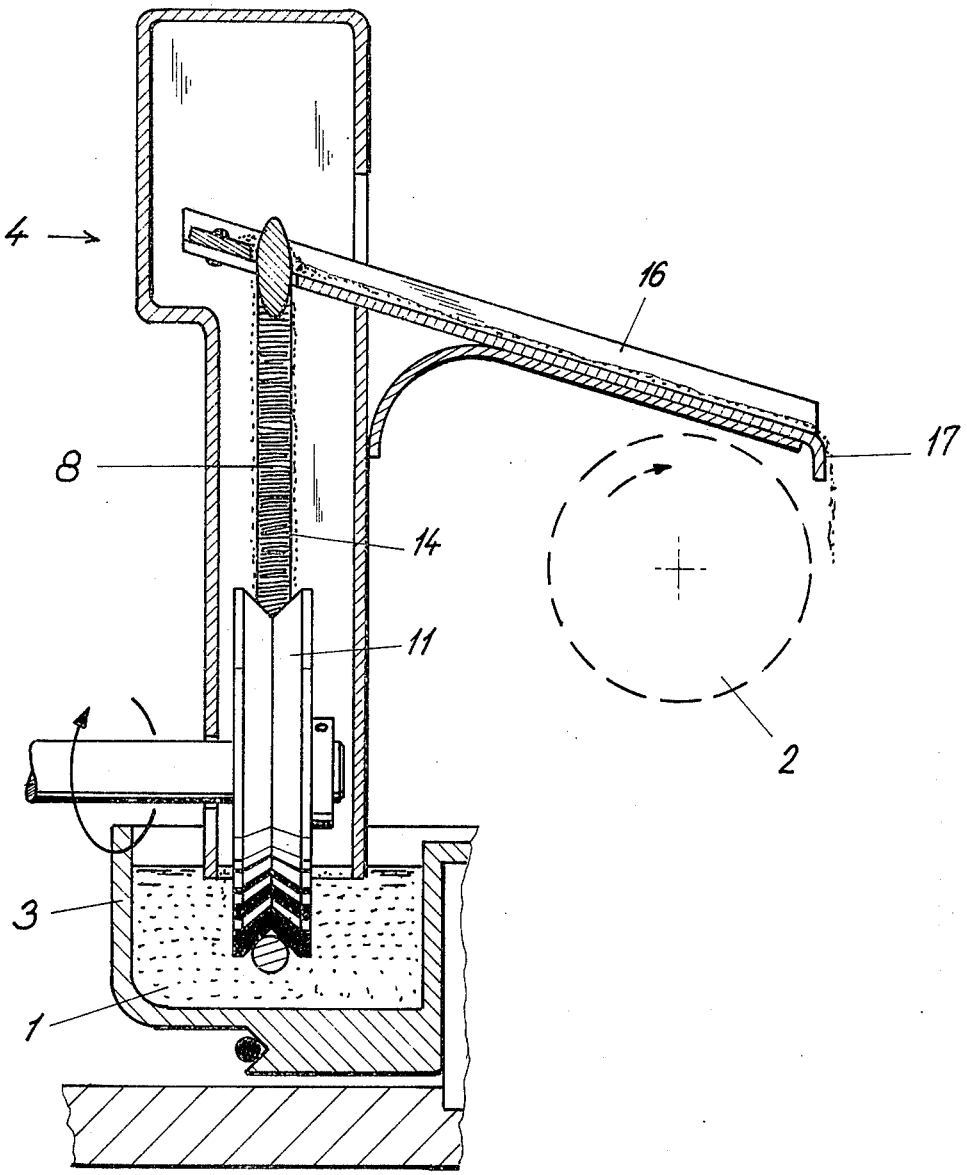
Figure 4:
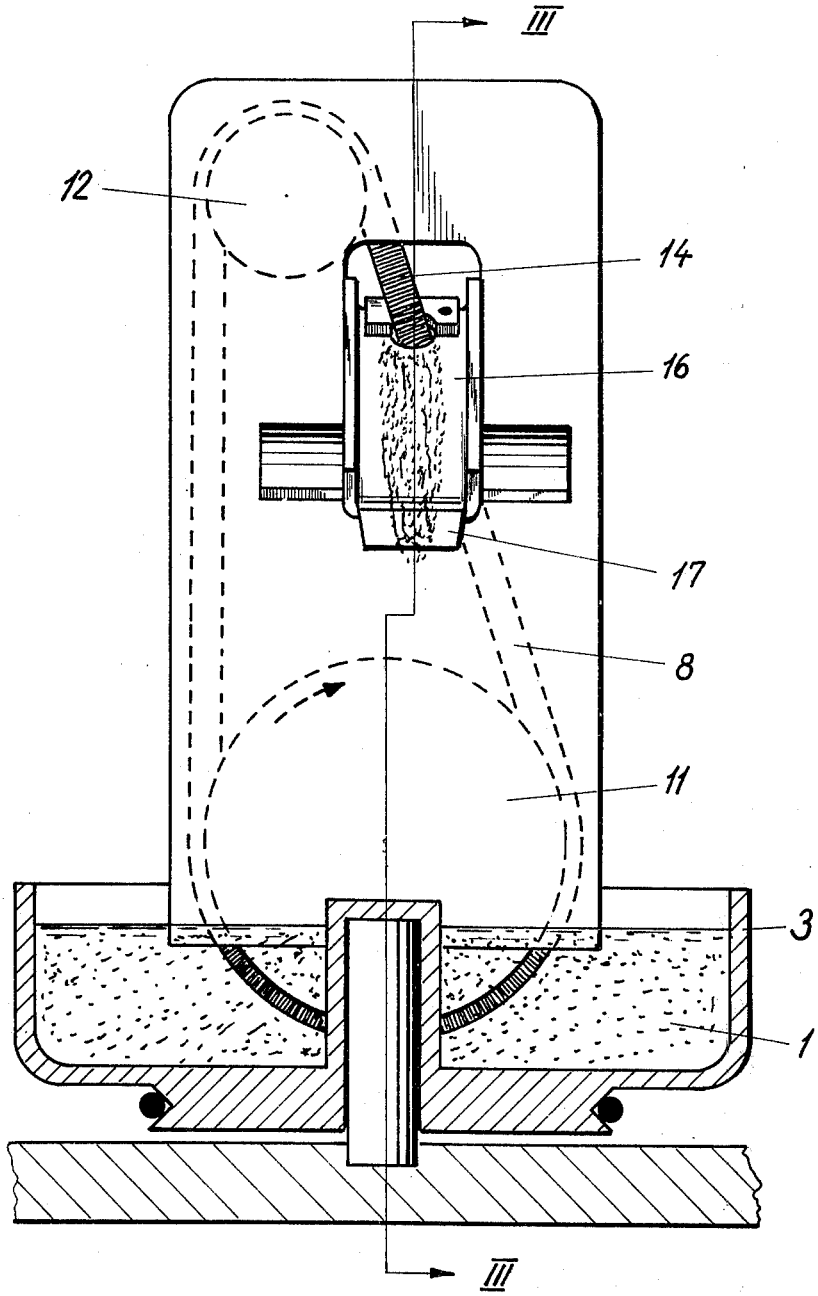
Figure 5:
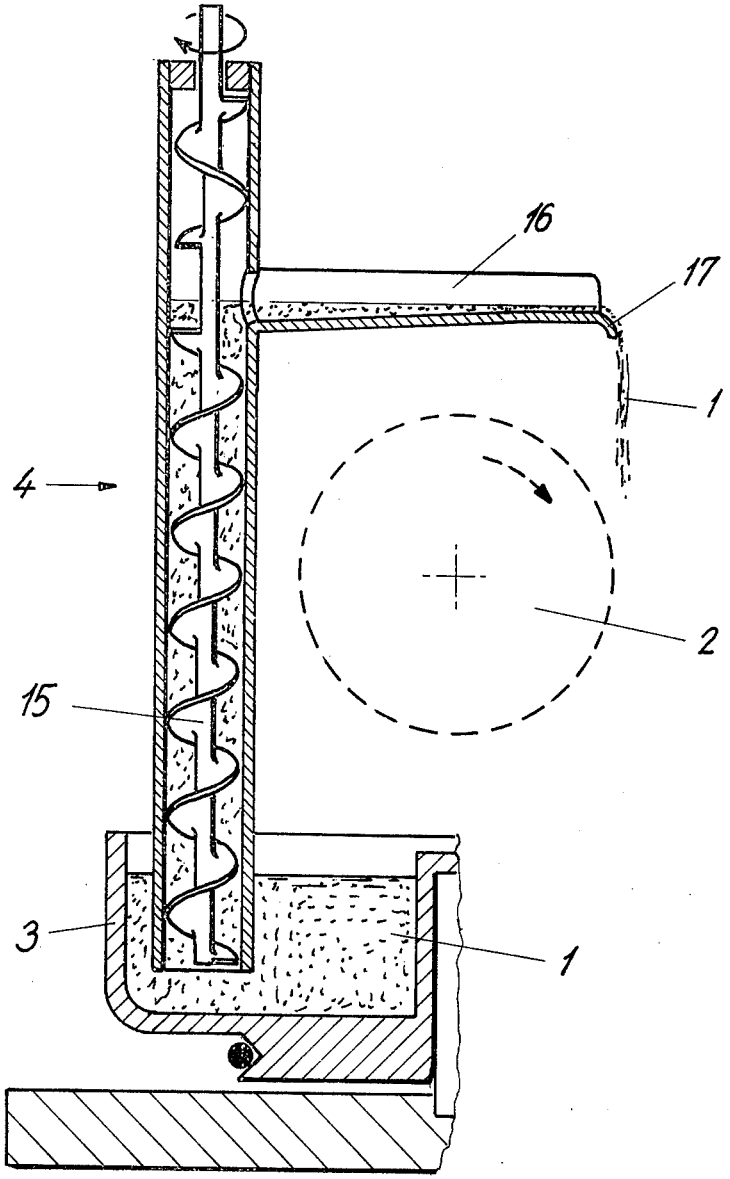

The invention will be further described, by way of example only, with reference to the accompanying drawings, in which:

FIG. 1 is a side view, partly in section along the line I—I in FIG. 2, of a grinding apparatus with a conveyor band, FIG. 2 is a section taken along the line II—II in FIG. 1, FIG. 3 is a side view, partly in section along the line III—III in FIG. 4, of another grinding apparatus with a conveyor band, FIG. 4 is a front view, partly in section, of the apparatus shown in FIG. 3 without a grinding disc, and FIG. 5 is a side view, partly in section, of a further grinding apparatus with a screw conveyor.

The combined mixing, grinding material transport, and grinding apparatus shown in FIG. 1 is indicated by reference numeral 4 and includes a bottom plate on which is mounted a cup 3 which is free to rotate and which contains grinding material 1, which comprises for example pumice powder and water. The cup 3 is rotated for example by an electric motor through a belt drive as shown in FIG. 2. In this way the cup 3 is kept constantly rotating. For the purpose of mixing pumice and water an element 5 similar to a comb, is provided which includes a row of teeth 6 placed in the cup and extending from the outer edge of the cup to its center and from the upper edge of the cup to its bottom. Only a single element 5 is shown but more than one such element may be provided, if required by the consistency of the grinding material. During the grinding operation the mixing ratio can be changed by delivering liquid or grinding material, and the mixing process is quickly carried out in the rotating cup 3.

The grinding material may be transported to the place of operation by one of several means. The apparatus shown in FIGS. 1 and 2 includes a number of wheels or rollers, 9, 10, 12 around which an endless band 7 is wrapped. This band is flat and is provided with pockets 13 on the outer side perpendicular to the band. These pockets contain some fluid grinding material 1 on the way from the cup 3 over a wheel or roller 12 which is placed nearly vertical above the wheel or roller 9 in the cup 3 and up to a wheel or roller 10 which is placed above a rotating grinding disc or brush 2. The wheel or roller 12 is driven by a driving mechanism whose rotational speed can be readily adjusted.

The pockets 13 are spaced equally along the band and are filled when the band 7 is rotated, and these pockets are emptied when the band turns around the wheel or roller 10. The grinding material is thrown or drops down on the work piece to be treated by holding the piece against the rotating disc or brush 2. If the piece is not placed in that position the grinding material drops down again into the cup 3. The quantity of grinding material delivered to the place of operation can be controlled by changing the speed of the band 7; more material is conveyed at higher speeds and vice versa. This speed can be controlled for example by providing a stepless variable speed motor to drive the wheel or roller 12, this motor being operated for example by a foot pedal. The foot pedal has the advantage that both hands are free to perform the grinding operation and is therefore preferred for practical reasons. The band can be made of rubber or some similar material.

The conveyor arrangement has the further advantage that it provides a shield for the grinding disc or brush 2. The material which has been abraded and the grinding material are thrown against the inner wall of the apparatus 4 and from here they slide down into the cup 3. During the grinding operation it may be necessary to inspect the work piece; this can be easily done by stopping the motion of the band and consequently stopping the delivery of grinding material 1 so that the piece can be brushed clean by the brush 2.

FIGS. 3 and 4 show apparatus 4 which employs an endless band 8 of approximately circular cross-section and provided with transverse slots or pockets 14 which contain the grinding material when moving up from the cup 3. The band 8 passes around two wheels or rollers 11, 12 only, the wheels or rollers being placed in the same plane perpendicular to the axis of the disc or brush 2. To convey the material forward a channel 16 is provided having at one end an opening through which the band 8 passes. When the band passes through this opening the grinding material is scraped off by the upper side of the channel 16 and it is delivered from there to the place of operation. The channel has at its other end an elongate nose 17 which forms an extension of the channel bottom and which partly distributes the stream of grinding material evenly over the whole width of the disc or brush 2 and together with the channel 16 partly shields the disc or brush in the same way as in the apparatus shown in FIGS. 1 and 2. The slots or pockets 14 are also equally spaced so that the conveyance of grinding material is uniform and only depends on the speed of the band 8. This speed can be varied in the same way as in the apparatus shown in FIGS. 1 and 2, for example by means of a foot or knee operated switch for a stepless variable speed electromotor.

FIG. 5 shows apparatus 4 which employs a screw conveyor 15 rotating around its axis, which for example is placed vertically. The grinding material is lifted to a channel 16 which delivers the mixture to the place of operation. The rotational speed of the screw is determined by the guantity of grinding material which is to be conveyed to the work piece to be treated, in the same way as described in connection with the other embodiments.

An advantage of the process described above is that it reduces substantially the amount of dust that is generated, which constitutes a big problem in the hitherto customary manual application. This is due to the continuous delivery of fluid grinding material to the place of operation, which causes the pumice to be wetted so that it does not dry out and therefore is not blown in the room by the air stream from the disc or brush 2.

The above description has been with reference to denture work, the grinding means being pumice mixed in water. However, this process may be used when treating other objects, particularly smaller objects, which are to be ground and polished by means of a suitable grinding material in fluid form.

What is claimed is:

1. A grinding or polishing apparatus, comprising:

a rotatable grinding or polishing element;

a cup disposed beneath said rotatable element and including a bottom wall and a generally vertical peripheral wall, said cup being mounted for rotation about a generally vertical axis passing centrally therethrough, and being adapted to contain fluid grinding material, and to receive fluid grinding material falling from said rotatable element;

drive motor means connected with said cup for effecting rotation thereof about said axis;

a comb-like member fixedly mounted to extend generally radially across the top of said rotatable cup, said member extending over at least a major portion of the radial distance from said peripheral wall to said axis, and carrying a plurality of spaced, downwardly projecting teeth arranged to effect mixing of fluid grinding material disposed in said cup during rotation of said cup relative to said member;

shield means mounted to extend generally above and over said rotatable element, and including a discharge point disposed above said element and positioned to correctly deposit fluid grinding material falling therefrom for the operation of said element; and conveyor means of variable capacity mounted with one end thereof in said cup for collecting fluid grinding material therefrom, the other end of said conveyor means leading to said discharge point of said shield means.

2. Apparatus according to claim 2, wherein said conveyor means comprises an endless conveyor band having pockets for containing the fluid material, said band passing over spaced rotating roller means which are mounted on said shield means so that at least part of one roller means is immersed in the fluid grinding material in the cup, said band being arranged to empty fluid grinding material taken from said cup toward said discharge point, and said conveyor band being driven by means whose speed is adjustable.

3. Apparatus according to claim 2 wherein said conveyor band is flat and is provided on its outer side with a plurality of equally spaced transverse flexible pockets for containing a fluid material.

4. Apparatus according to claim 2, wherein said conveyor band is of circular cross-section and is provided with equally spaced ring-shaped flexible pockets for containing said fluid grinding material, said shield means including an inclined channel leading from said discharge point to said conveyor band, and arranged to accept fluid grinding material carried thereto by said conveyor band.

5. Apparatus according to claim 1, wherein the conveyor means comprises a screw element whose rotational speed is adjustable, the lower end of said screw element being immersed in the fluid grinding material in the cup.

6. Apparatus according to claim 5, wherein the conveyor means delivers fluid grinding material to an inclined channel carried by said shield means, and leading to said discharge point.

* * * * *